US009494959B2

(12) United States Patent
Hu et al.

(10) Patent No.: US 9,494,959 B2
(45) Date of Patent: Nov. 15, 2016

(54) CURRENT SOURCE FOR VOLTAGE REGULATOR AND VOLTAGE REGULATOR THEREOF

(71) Applicant: NOVATEK Microelectronics Corp., Hsin-Chu (TW)

(72) Inventors: Min-Hung Hu, Hsinchu (TW); Chiu-Huang Huang, Hsinchu County (TW); Chen-Tsung Wu, Kaohsiung (TW); Chun-Wei Huang, Hsinchu County (TW); Pin-Han Su, Taichung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 37 days.

(21) Appl. No.: 14/554,009

(22) Filed: Nov. 25, 2014

(65) Prior Publication Data

US 2016/0011615 A1 Jan. 14, 2016

(30) Foreign Application Priority Data

Jul. 11, 2014 (TW) ..... 103123929 A

(51) Int. Cl.
*G05F 1/56* (2006.01)
*G05F 1/565* (2006.01)

(52) U.S. Cl.
CPC ..... *G05F 1/565* (2013.01)

(58) Field of Classification Search
CPC ..... G05F 1/575
USPC ..... 323/281–289, 351
See application file for complete search history.

(56) References Cited

U.S. PATENT DOCUMENTS

| | | | | |
|---|---|---|---|---|
| 6,054,901 | A * | 4/2000 | Nainar | H03F 1/302 330/292 |
| 6,465,994 | B1 | 10/2002 | Xi | |
| 7,106,033 | B1 | 9/2006 | Liu | |
| 2009/0212753 | A1 | 8/2009 | Lou | |
| 2010/0315194 | A1 * | 12/2010 | Park | G01D 5/14 340/5.1 |
| 2012/0319665 | A1 | 12/2012 | Hu | |

FOREIGN PATENT DOCUMENTS

| | | | |
|---|---|---|---|
| CN | 1432885 | A | 7/2003 |
| CN | 102841624 | A | 12/2012 |
| CN | 103186158 | A | 7/2013 |
| CN | 103838286 | A | 6/2014 |
| TW | 200634467 | | 10/2006 |
| TW | 200933333 | | 8/2009 |
| TW | 201207591 | | 2/2012 |

OTHER PUBLICATIONS

Hazucha, Area-Efficient Linear Regulator With Ultra-Fast Load Regulation, IEEE Journal of Solid-State Circuits, vol. 40, No. 4, Apr. 2005.

* cited by examiner

*Primary Examiner* — Adolf Berhane
*Assistant Examiner* — Nusrat Quddus
(74) *Attorney, Agent, or Firm* — Winston Hsu; Scott Margo

(57) ABSTRACT

A current source for quickly adjusting an output current includes a constant current generation module, coupled to a control node, for generating a predefined current flowing through the control node in order to determine a voltage of the control node; a capacitor, coupled to an output terminal of the current source; a current variation detection module, coupled between the control node and the capacitor, for generating a variation on the voltage of the control node via the capacitor when the output terminal of the current source receives an instant current variation; and a trans-conductance amplifier, coupled between the control node and the output terminal, for changing a magnitude of the output current of the output terminal when the variation on the voltage of the control node is generated.

9 Claims, 10 Drawing Sheets

CURRENT SOURCE FOR VOLTAGE REGULATOR AND VOLTAGE REGULATOR THEREOF

BACKGROUND OF THE INVENTION

1. Field of the Invention

The present invention relates to a current source for a voltage regulator, and more particularly, to a current source capable of quickly adjusting an output current of a voltage regulator, and a voltage regulator thereof.

2. Description of the Prior Art

A voltage regulator utilizes a feedback circuit to maintain its desired output voltage. A voltage regulation capacitor is disposed in the output terminal of the voltage regulator to assist in regulation capability of the voltage regulator. The voltage regulation capacitor is responsible for converting pre-stored charge into a driving current that can be provided to the load driven by the voltage regulator when its current requirement changes rapidly. This can maintain stability in the output voltage of the output terminal. In order to allow the voltage regulator to support large current variations, a large voltage regulation capacitor should be applied, which increases the cost of the voltage regulator and also reduces the response speed.

The industry has therefore developed voltage regulators that do not require voltage regulation capacitors. These voltage regulators possess complex detection circuits that detect dynamic changes in the output voltage of the load terminal, and can dynamically adjust driving currents according to the detected output voltage variations. One common voltage regulator applies an N-type metal oxide semiconductor field-effect transistor (NMOS) as a power supply transistor instead of a P-type metal oxide semiconductor field-effect transistor (PMOS). The NMOS has a smaller tuning range in its output voltage than a PMOS; its gate-to-source voltage (Vgs) may therefore increase significantly when there is a rapid rise in the current requirement of the load terminal. This leads to a quick fall in the source voltage of the NMOS and failure to achieve a stable output voltage. U.S. Publication No. 2009/0212753 A1 and U.S. Pat. No. 7,106,033 B1 respectively teach another voltage regulator circuit structure, which utilizes a comparator to compare the output voltage with a reference voltage to enable an instant current source when the output voltage falls below a predefined level. The voltage regulator further applies another comparator to compare the output voltage with another reference voltage to disable the instant current source when the output voltage is sufficiently high or when an overvoltage due to an excessively large output current occurs. These types of voltage regulator require a more complex circuit design, which increases the cost and results in redundant power consumption. Furthermore, the instant current source is enabled after the output voltage has an evident fall, which limits the regulation effect in the output voltage. Since these circuit structures have two comparators controlled by two control loops, stability problems may easily occur.

As technology processes progress, the density of digital circuits becomes higher and their associated functionalities become more powerful, which results in larger instant currents. Modern voltage regulators without voltage regulation capacitors are not adequate for the required response speed. Even voltage regulators including voltage regulation capacitors are unable to provide a satisfactory voltage regulation effect due to parasitic resistances inside or outside the chip when the current requirement in the load terminal keeps increasing. Thus, there is a need for improvement over the prior art.

SUMMARY OF THE INVENTION

It is therefore an objective of the present invention to provide a current source and voltage regulator capable of quickly adjusting output currents, to quickly adjust the magnitude of the output current when a load terminal requires a large instant current, and thereby stabilize the output voltage while preventing the output voltage from being pulled down by the load current and causing malfunctions.

The present invention discloses a current source for quickly adjusting a first output current. The current source comprises a constant current generation module coupled to a control node, for generating a predefined current flowing through the control node in order to determine a voltage of the control node; a capacitor coupled to an output terminal of the current source; a current variation detection module coupled between the control node and the capacitor, for generating a variation on the voltage of the control node via the capacitor when the output terminal of the current source receives an instant current variation; and a trans-conductance amplifier coupled between the control node and the output terminal, for changing a magnitude of the first output current of the output terminal when variation on the voltage of the control node is generated.

The present invention further discloses a voltage regulator. The voltage regulator comprises a buffer coupled between an output terminal of the voltage regulator and a quick response control terminal, for generating an output current; a current source coupled to the buffer; and a voltage regulation amplifier coupled between the output terminal of the voltage regulator and the quick response control terminal, for maintaining an output voltage of the output terminal and determining a bias voltage of the quick response control terminal. The current source comprises a constant current generation module coupled to a control node, for generating a predefined current flowing through the control node in order to determine a voltage of the control node; a capacitor coupled to the output terminal of the voltage regulator; a current variation detection module coupled between the control node and the capacitor, for generating a variation on the voltage of the control node via the capacitor when the output terminal of the voltage regulator receives an instant current variation; and a trans-conductance amplifier coupled between the control node and the quick response control terminal, for generating an output signal on the quick response control terminal when the variation on the voltage of the control node is generated in order to control the buffer to change a magnitude of the output current.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
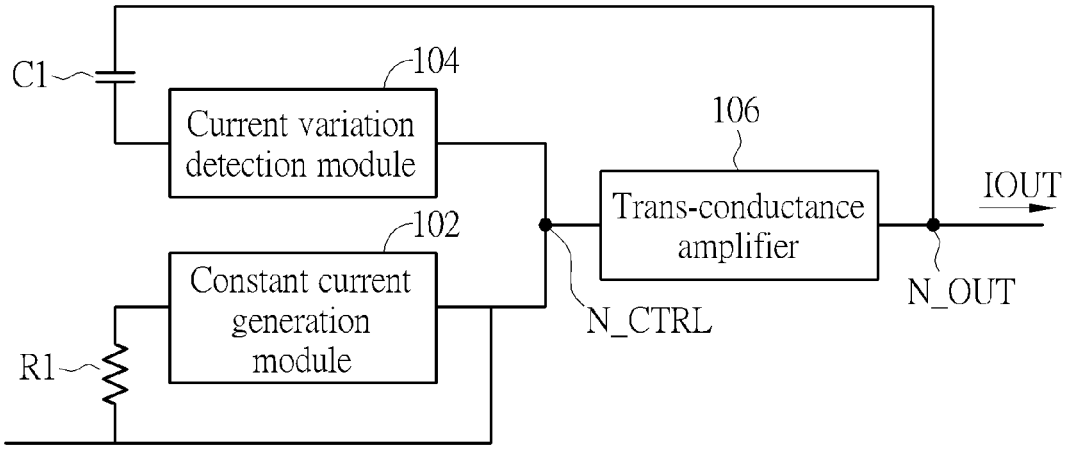
FIG. 1 is a schematic diagram of a current source according to an embodiment of the present invention.

FIG. 1 is a schematic diagram of a current source 10 according to an embodiment of the present invention. The current source 10 includes a constant current generation module 102, a capacitor C1, a current variation detection module 104 and a trans-conductance amplifier 106. The constant current generation module 102, coupled to a control node N_CTRL, is utilized for generating a predefined current flowing through the control node N_CTRL in order to determine the voltage of the control node N_CTRL. The predefined current is mainly utilized for adjusting the bias voltage of the control node N_CTRL, and may be a smaller current to prevent unnecessary power consumption. The capacitor C1 is coupled between an output terminal N_OUT of the current source 10 and the current variation detection module 104. The current variation detection module 104, coupled between the control node N_CTRL and the capacitor C1, may generate a variation on the voltage of the control node N_CTRL via the capacitor C1 when the output terminal N_OUT of the current source 10 receives an instant current variation. The trans-conductance amplifier 106 is coupled between the control node N_CTRL and the output terminal N_OUT. When a variation occurs on the voltage of the control node N_CTRL, the trans-conductance amplifier 106 may change the magnitude of an output current IOUT of the output terminal N_OUT according to the variation. In an embodiment, the current source 10 may further include a resistor R1 coupled between the control node N_CTRL and the constant current generation module 102, for preventing the constant current generation module 102 from generating another instant current to offset the variation on the voltage of the control node N_CTRL.

The current source 10 may provide currents for a system on a chip; hence, every circuit requiring a power supply in the system may be considered as the load of the current source 10. When the load current quickly changes, the capacitor C1 may immediately respond and generate a variation on the voltage of the control node N_CTRL. The trans-conductance amplifier 106 then outputs the output current IOUT corresponding to the magnitude of the voltage of the control node N_CTRL. For example, when the load instantly requires a large current, the load may draw currents from every parasitic capacitor containing charge in the circuit system, and also draw current from the capacitor C1 causing the voltage of the control node N_CTRL coupled to the capacitor C1 to fall. When detecting that the voltage of the control node N_CTRL falls, the trans-conductance amplifier 106 may increase the magnitude of the output current IOUT, so that the output current IOUT may satisfy the requirement of instant load current. This prevents the output voltage from being pulled down by the load current to cause malfunction. When the current requirement of the load terminal is reduced instantly, since the output current IOUT is larger, the redundant current may raise the voltage of the control node N_CTRL via the capacitor C1. When detecting that the voltage of the control node N_CTRL rises, the trans-conductance amplifier 106 may decrease the magnitude of the output current IOUT, or may even draw out the excess output current IOUT. This prevents the output voltage from rising excessively, which may cause the circuit to lose efficacy or generate negative influences.

Note that, in the conventional current source circuits or voltage regulator circuits, the direct current (DC) loop and alternating current (AC) loop are usually formed in the same feedback circuit. If the loop bandwidth increases to enhance the response speed of the current source, the stability of the circuit may be sacrificed. If stability is a consideration, the response speed will be limited. In comparison, according to the circuit structure shown in FIG. 1, the constant current generation module 102 and the resistor R1 may form the DC loop; and the capacitor C1, the current variation detection module 104 and the trans-conductance amplifier 106 may form the AC loop (i.e. the small signal loop). In such a situation, the DC loop is separated from the AC loop. If the response speed of the current source needs to be enhanced, only the bandwidth of the AC loop should be enhanced while the DC loop may not be influenced, so that the DC loop may obtain a higher stability.

Figure 2:
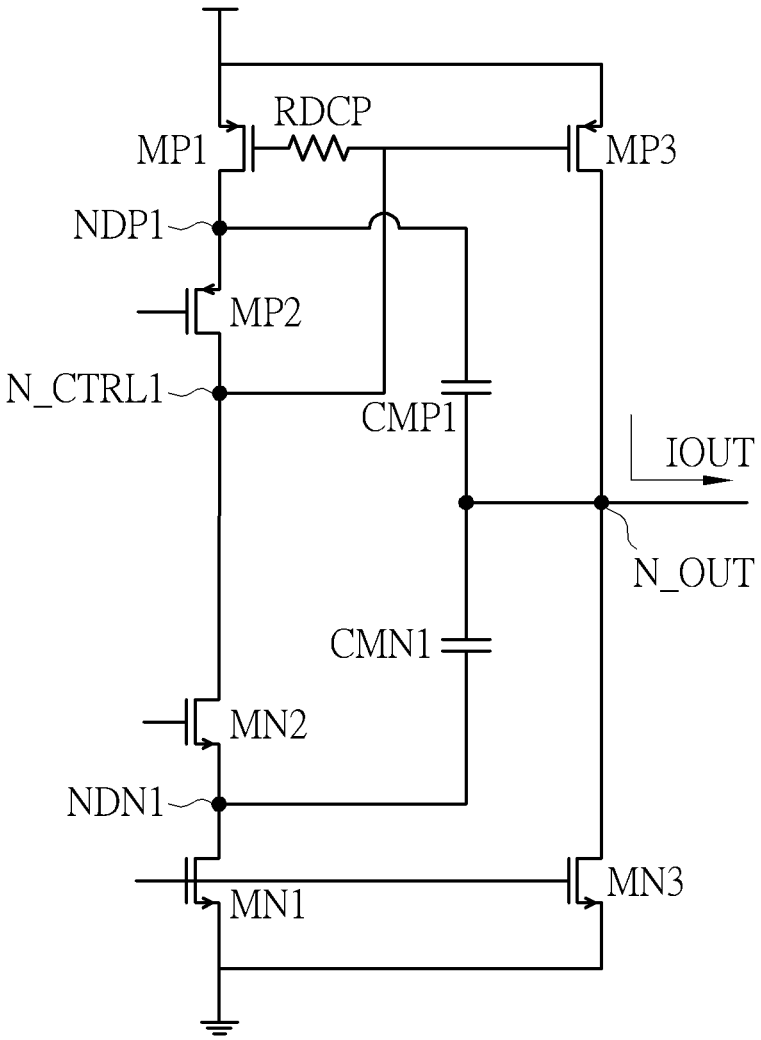
FIG. 2 is a schematic diagram of an implementation of the current source shown in FIG. 1.

FIG. 2 is a schematic diagram of an implementation of the current source 10. The circuit structure of the current source 10 may include P-type metal oxide semiconductor field-effect transistors (PMOS) MP1, MP2 and MP3, N-type metal oxide semiconductor field-effect transistors (NMOS) MN1, MN2 and MN3, capacitors CMP1 and CMN1 and a resistor RDCP. The PMOS MP1 and MP3 form a current mirror, and the NMOS MN1 and MN3 are utilized, respectively, for sinking the currents of the PMOS MP1 and MP3. The PMOS MP2 and the NMOS MN2 are coupled between the transistors MP1 and MN1. A control node N_CTRL1 is located between the transistors MP2 and MN2, so that the transistors MP2 and MN2 may control the voltage of the control node N_CTRL1. The capacitor CMP1 is coupled between the output terminal N_OUT and a node NDP1, wherein the output terminal N_OUT is located between the transistors MP3 and MN3, and the node NDP1 is located between the transistors MP1 and MP2. The capacitor CMN1 is coupled between the output terminal N_OUT and a node NDN1, wherein the node NDN1 is located between the transistors MN1 and MN2. Both the capacitors CMP1 and CMN1 may be regarded as a part of the capacitor C1 shown in FIG. 1. The resistor RDCP, coupled between the gate of the transistor MP1 and the control node N_CTRL1, may be regarded as a part of the resistor R1 shown in FIG. 1.

According to the current mirror formed by the transistors MP1 and MP3, the magnitude of the output current IOUT (i.e. the current flowing through the transistor MP3) may substantially be equal to the magnitude of the predefined current flowing through the transistor MP1 and the control node N_CTRL1 in the steady state. When the load instantly draws a large current, the load may draw currents from charges stored in the capacitors CMP1 and CMN1 via the output terminal N_OUT, which causes the voltages of the nodes NDP1 and NDN1 to fall quickly. The falling voltage of the node NDP1 may cause the transistor MP2 to be turned off rapidly, and the falling voltage of the node NDN1 may cause the current flowing through the transistor MN2 to significantly increase. This current may pull down the voltage of the control node N_CTRL1 quickly and significantly, so that the transistor MP3 may output the large current. Through the above operations, the transistor MP3 may rapidly provide the large current required by the load. Note that the resistor RDCP is disposed between the gate of the transistor MP1 and the control node N_CTRL1. The resistor RDCP aims at preventing the voltage on the gate of the transistor MP1 from falling quickly when the voltage of the control node N_CTRL1 falls quickly, while the falling voltage on the gate of the transistor MP1 may generate a large current that quickly flows through the transistor MP1 and rapidly raise the voltage of the control node N_CTRL1 (i.e. offsets the voltage variation on the control node N_CTRL1). In other words, the resistor RDCP may reduce the response speed of the transistor MP1, so that the voltage of the control node N_CTRL1 may recover after the output terminal N_OUT outputs enough current to satisfy the load requirement.

Figure 3:
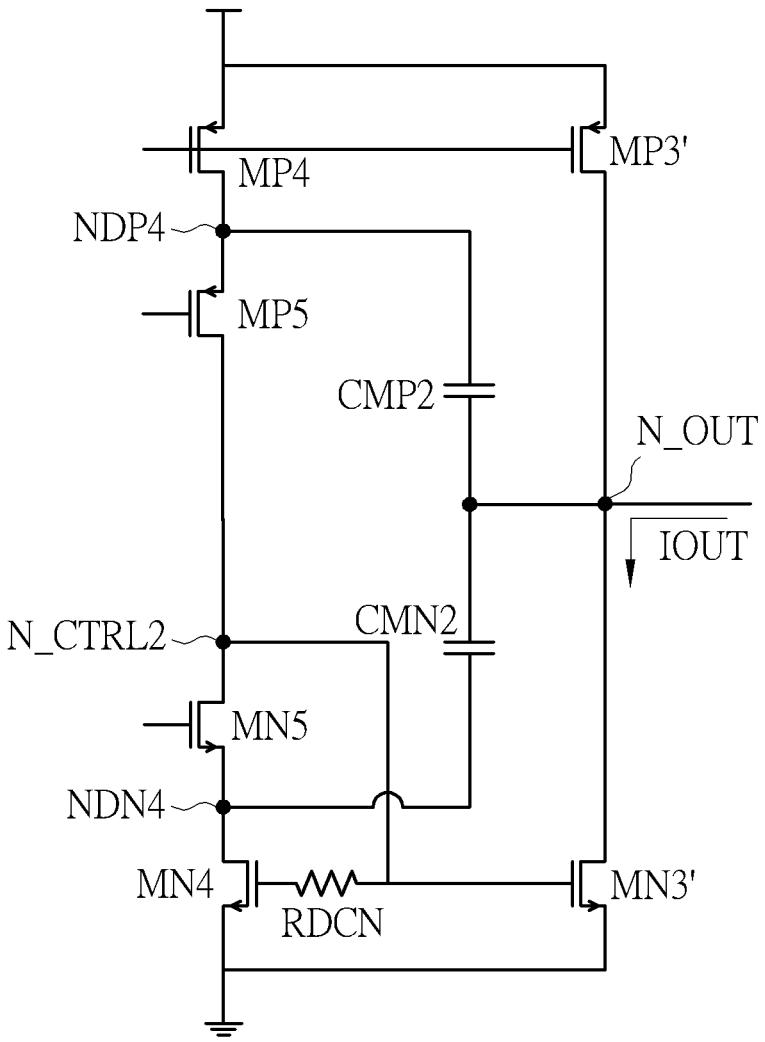
FIG. 3 is a schematic diagram of another implementation of the current source shown in FIG. 1.

In addition to rapidly satisfying the current requirement of the load terminal, the current source of the present invention may also quickly provide a path for sinking an excess current when the output current is excessively large. FIG. 3 is a schematic diagram of another implementation of the current source 10. The circuit structure of the current source 10 may include PMOS MP3', MP4 and MP5, NMOS MN3', MN4 and MN5, capacitors CMP2 and CMN2 and a resistor RDCN. The NMOS MN3' and MN4 form a current mirror, and the PMOS MP3' and MP4 are utilized, respectively, for sourcing the currents of the NMOS MN3' and MN4. The PMOS MP5 and the NMOS MN5 are coupled between the transistors MP4 and MN4. A control node N_CTRL2 is located between the transistors MP5 and MN5, so that the transistors MP5 and MN5 may control the voltage of the control node N_CTRL2. The capacitor CMP2 is coupled between the output terminal N_OUT and a node NDP4, wherein the output terminal N_OUT is located between the transistors MP3' and MN3', and the node NDP4 is located between the transistors MP4 and MP5. The capacitor CMN2 is coupled between the output terminal N_OUT and a node NDN4, wherein the node NDN4 is located between the transistors MN4 and MN5. Both the capacitors CMP2 and CMN2 may be regarded as a part of the capacitor C1 shown in FIG. 1. The resistor RDCN, coupled between the gate of the transistor MN4 and the control node N_CTRL2, may be regarded as a part of the resistor R1 shown in FIG. 1.

According to the current mirror formed by the transistors MN3' and MN4, the magnitude of the output current IOUT (i.e. the current flowing through the transistor MN3') may substantially be equal to the magnitude of the predefined current flowing through the transistor MN4 and the control node N_CTRL2 in the steady state. When the current requirement of the load is reduced rapidly, the excess current may flow to the capacitors CMP2 and CMN2 via the output terminal N_OUT, which causes the voltages of the nodes NDP4 and NDN4 to rise quickly. The rising voltage of the node NDN4 may cause the transistor MN5 to be turned off rapidly, and the rising voltage of the node NDP4 may cause the current flowing through the transistor MP5 to significantly increase. This current may pull up the voltage of the control node N_CTRL2 quickly and significantly, so that the transistor MN3' is able to sink the large current. Through the above operations, the transistor MN3' may rapidly generate a path capable of sinking the large current. Note that the resistor RDCN is disposed between the gate of the transistor MN4 and the control node N_CTRL2. The resistor RDCN aims at preventing the voltage on the gate of the transistor MN4 from rising quickly when the voltage of the control node N_CTRL2 rises quickly, while the rising voltage on the gate of the transistor MN4 may generate a large current that quickly flows through the transistor MN4 and rapidly reduce the voltage of the control node N_CTRL2 (i.e. offsets the voltage variation on the control node N_CTRL2). In other words, the resistor RDCN may reduce the response speed of the transistor MN4, so that the voltage of the control node N_CTRL2 may fall back after the transistor MN3' sinks the excess current in the output terminal N_OUT.

Figure 4:
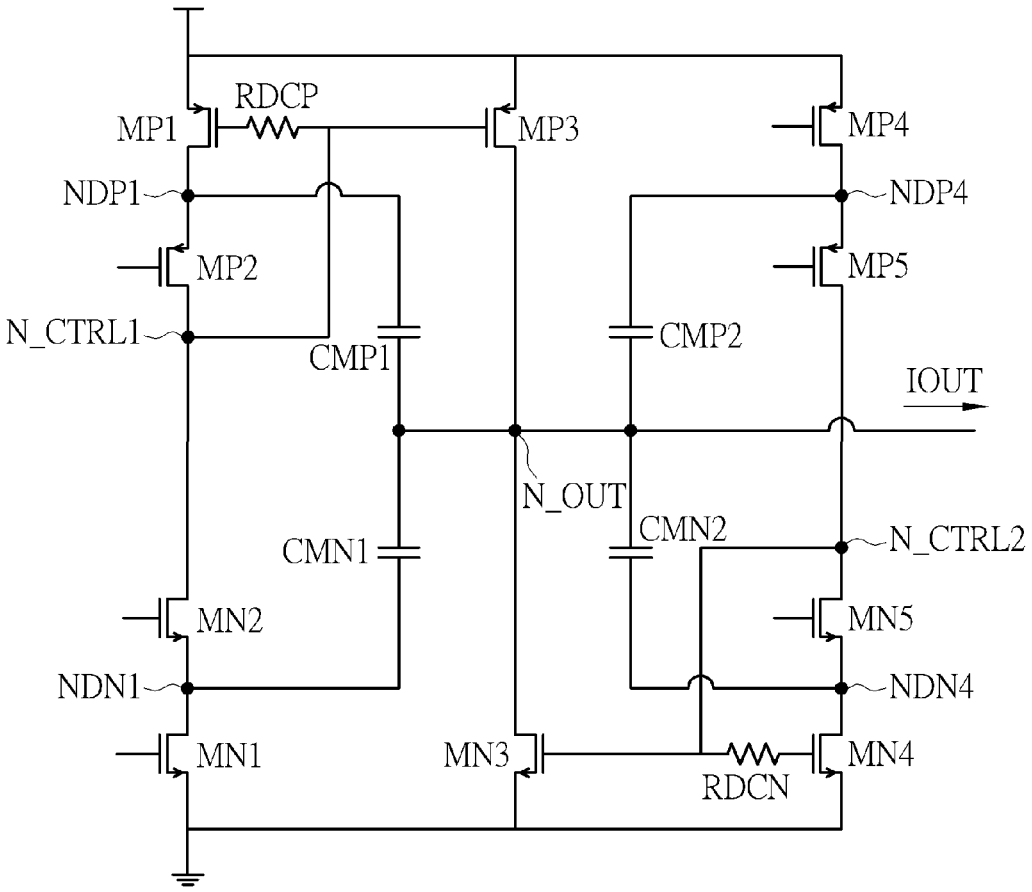
FIG. 4 is a schematic diagram of a further implementation of the current source shown in FIG. 1.

Note that the current source 10 may also be capable of the functions of quickly providing a large current and quickly sinking a large current. FIG. 4 is a schematic diagram of a further implementation of the current source 10. The circuit structure shown in FIG. 4 may be regarded as a combination of the circuit structures shown in FIG. 2 and FIG. 3, and circuit elements and signals having similar functions are denoted by the same symbols. The functions and operations of the transistors MP3 and MN3 shown in FIG. 4 are the same as those of the transistors MP3 and MN3 shown in FIG. 2, respectively, and are also the same as those of the transistors MP3' and MN3' shown in FIG. 3, respectively. Detailed operations related to the circuit structure of FIG. 4 are provided in the above descriptions of FIG. 2 and FIG. 3, and are therefore not narrated herein.

Figure 5:
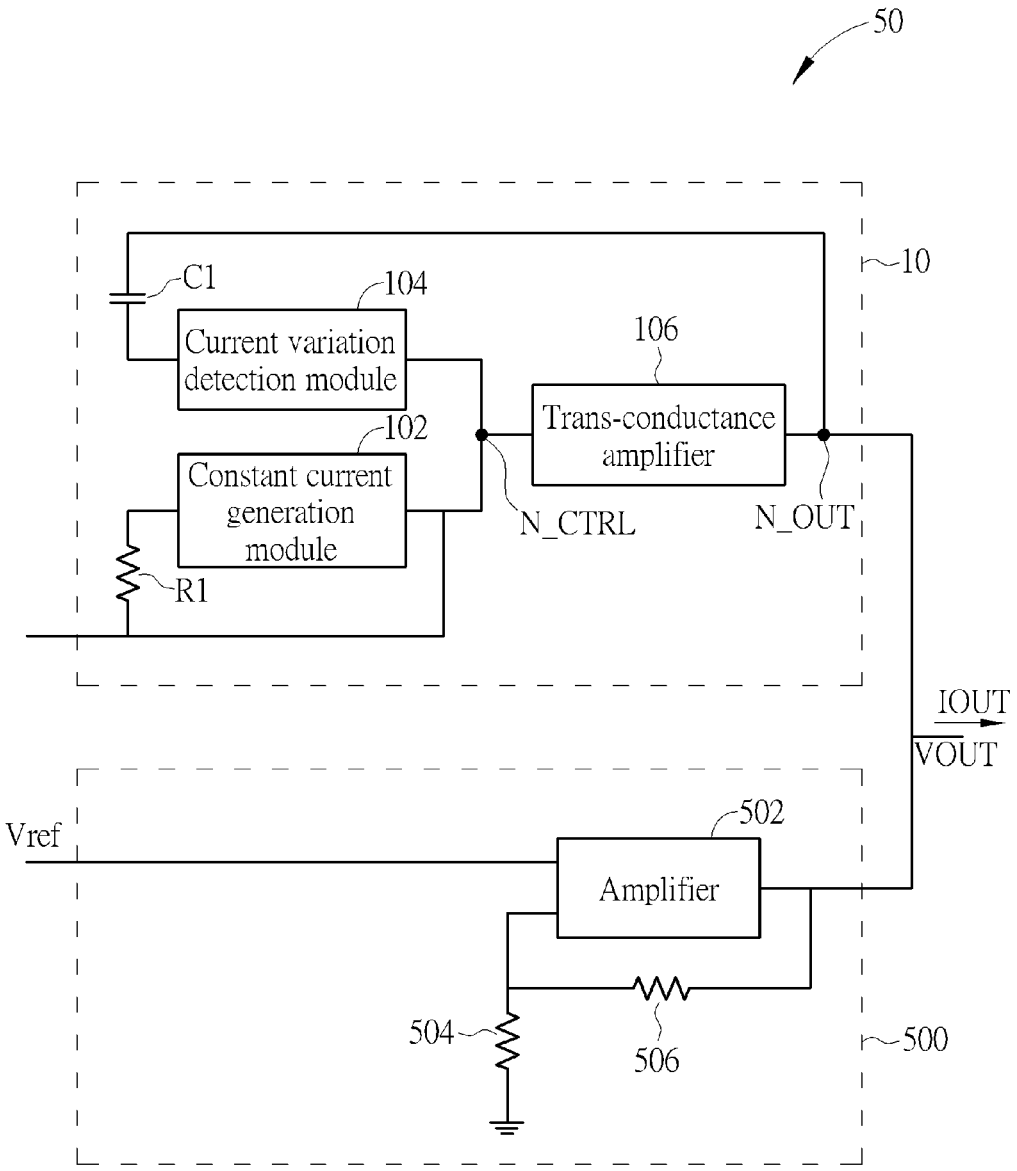
FIG. 5 is a schematic diagram of a voltage regulator according to an embodiment of the present invention.

The current source 10 of the present invention may be applied to various types of voltage regulators in order to stably output a predefined voltage to the load terminal according to system requirements. In such a situation, the output terminal of the current source 10 may further be coupled to an amplifier, voltage dividing resistors and other related circuit elements to form a voltage regulator. FIG. 5 is a schematic diagram of a voltage regulator 50 according to an embodiment of the present invention. The voltage regulator 50 includes the current source 10 and a voltage regulation amplifier 500. The voltage regulation amplifier 500 is utilized for maintaining an output voltage VOUT of the output terminal of the voltage regulator 50. The voltage regulation amplifier 500 includes an amplifier 502 and voltage dividing resistors 504, 506. The output terminal of the amplifier 502 is coupled to the output terminal of the current source 10, to be the output terminal of the voltage regulator 50 that provides the output voltage VOUT for the load. The voltage dividing resistors 504 and 506 may form a feedback circuit to maintain the output voltage VOUT on the output terminal of the voltage regulator 50 at a predetermined value in the steady state based on a reference voltage Vref. When the current requirement of the load terminal is fixed (i.e. steady state), the value of the output voltage VOUT is controlled by the voltage regulation amplifier 500, while the current source 10 may not affect the value of the output voltage VOUT. When a rapid variation occurs in the current requirement of the load terminal, the current source 10 then quickly provides a large current or sinks a large current.

Figure 6:
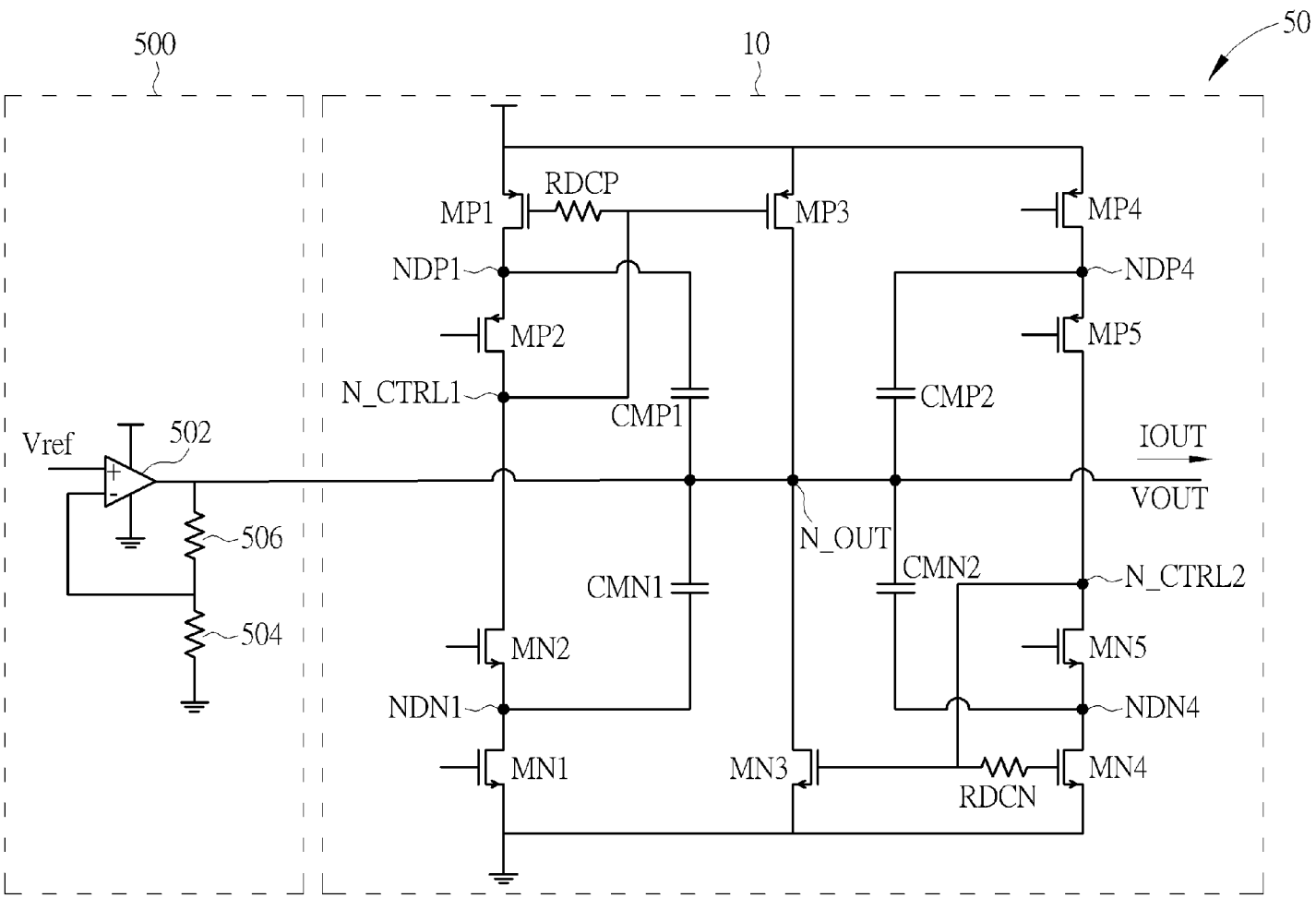
FIG. 6 is a schematic diagram of an implementation of the voltage regulator shown in FIG. 5.

FIG. 6 is a schematic diagram of an implementation of the voltage regulator 50. As shown in FIG. 6, the circuit structure of the current source 10 is as shown in FIG. 4, and the current source 10 together with the amplifier 502 and the voltage dividing resistors 504, 506 of the voltage regulation amplifier 500 realize the circuit structure of the voltage regulator 50. Detailed operations related to the circuit structure shown in FIG. 6 are provided in the above descriptions of FIG. 2, FIG. 3 and FIG. 5, and will therefore not be narrated herein.

Figure 7:
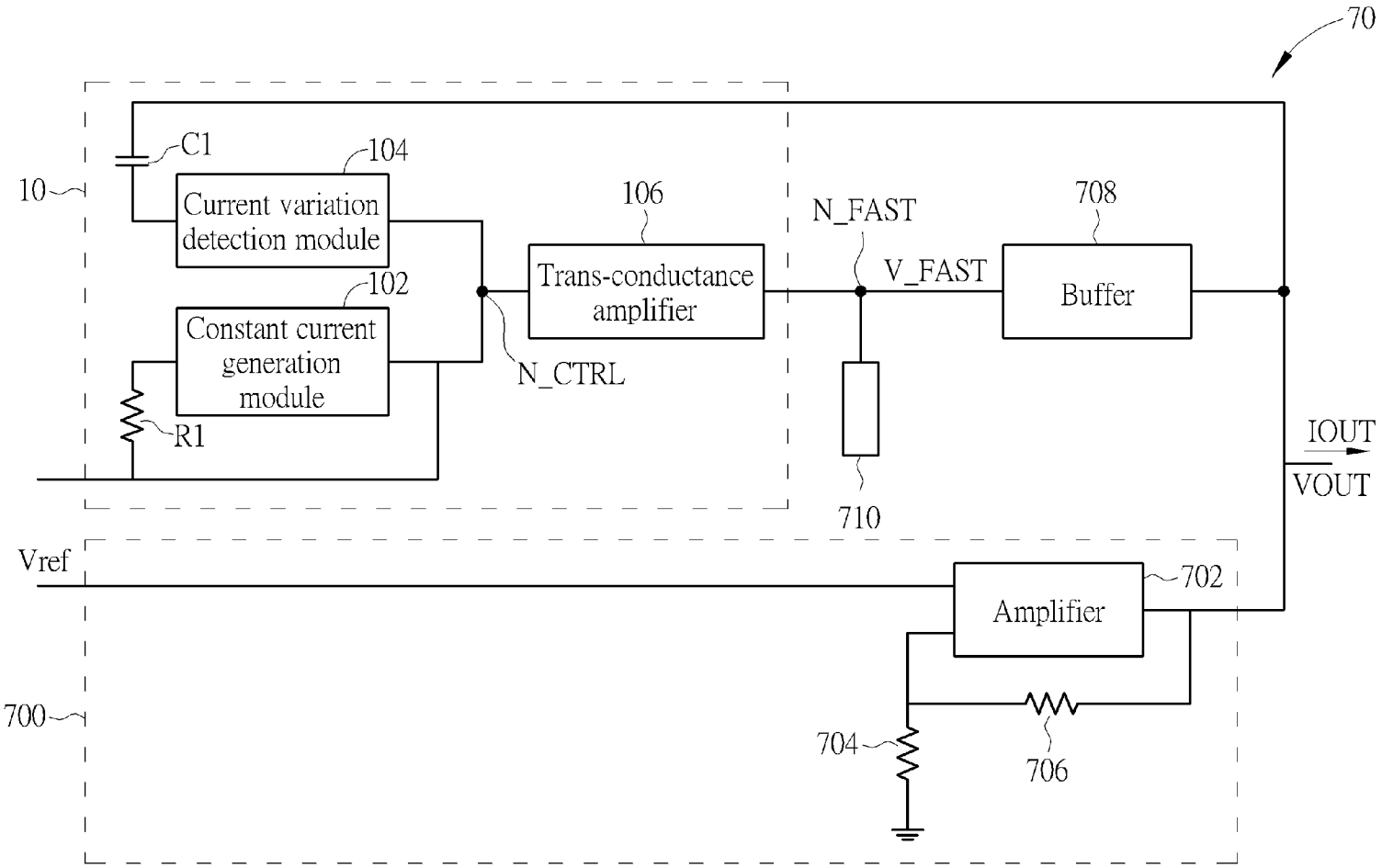
FIG. 7 is a schematic diagram of another voltage regulator according to an embodiment of the present invention.

In an embodiment, the current source 10 may not directly output currents; instead, a resistance may convert the output current of the current source 10 into an output voltage with quick variations in order to control a buffer to output currents, wherein the driving capability of the buffer may increase the speed of supplying currents to the load. FIG. 7 is a schematic diagram of another voltage regulator 70 according to an embodiment of the present invention. The voltage regulator 70 includes the current source 10, a voltage regulation amplifier 700, a buffer 708 and a conversion resistor 710. The voltage regulation amplifier 700 is utilized for maintaining the output voltage VOUT on the output terminal of the voltage regulator 70. The voltage regulation amplifier 700 includes an amplifier 702 and voltage dividing resistors 704, 706. The output terminal of the amplifier 702 is coupled to the output terminal of the buffer 708, to be the output terminal of the voltage regulator 70 that provides the output voltage VOUT to the load. The voltage dividing resistors 704 and 706 may form a feedback circuit to maintain the output voltage VOUT on the output terminal of the voltage regulator 70 at a predetermined value in the steady state based on a reference voltage Vref. The conversion resistor 710 may convert the instant current generated by a quick response of the current source 10 into a voltage, and generate a quick voltage variation on a quick response control terminal N_FAST. The quick response control terminal N_FAST then controls the buffer 708 to output a current to the load. When the current requirement of the load terminal is fixed (i.e. steady state), the value of the output voltage VOUT is controlled by the voltage regulation amplifier 700, while the current source 10 and the buffer 708 may not affect the value of the output voltage VOUT. When a rapid variation occurs in the current requirement of the load terminal, the current source 10 and the quick response control terminal N_FAST then controls the buffer 708 to quickly provide a large current.

Figure 8:
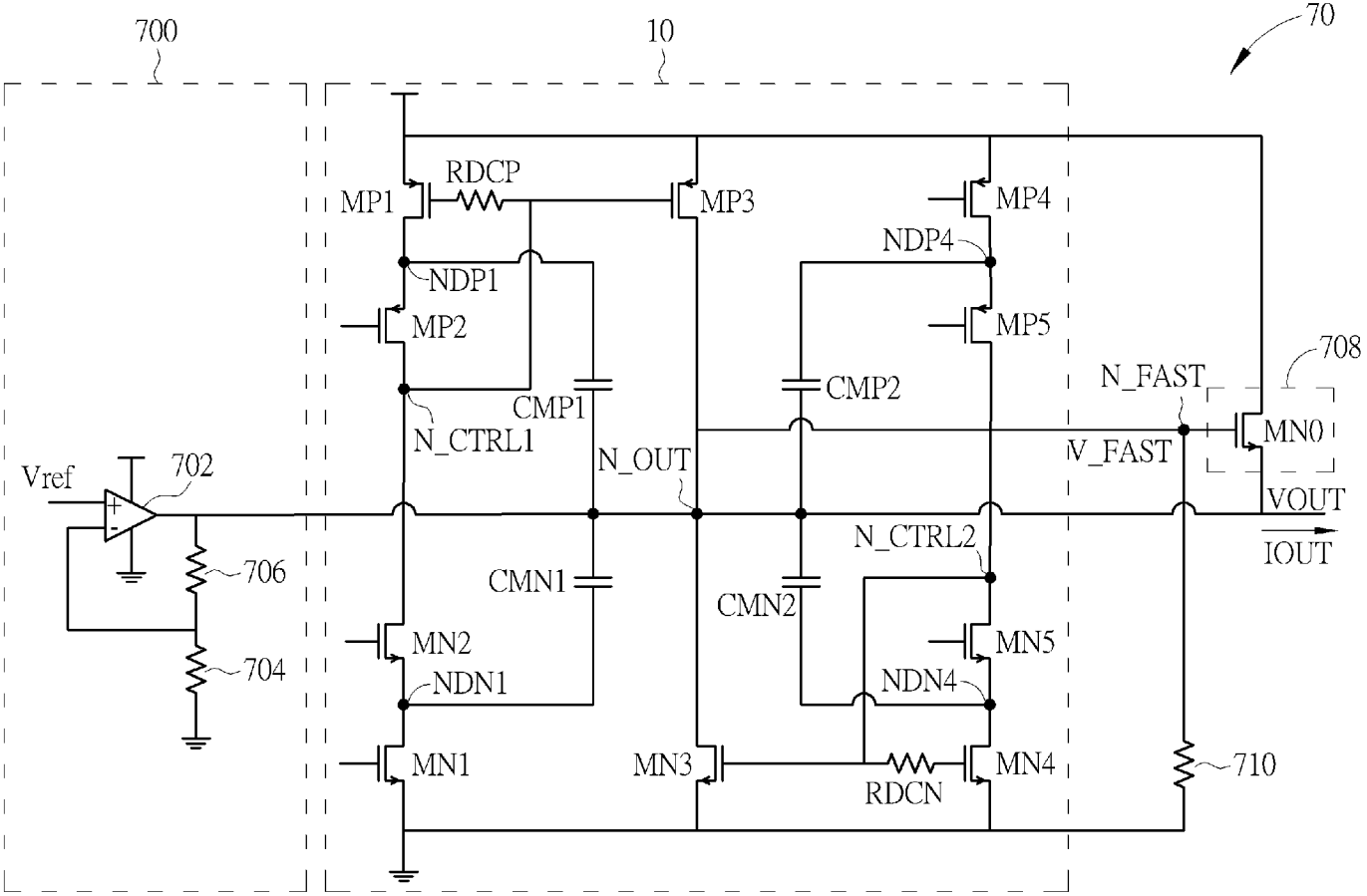
FIG. 8 is a schematic diagram of an implementation of the voltage regulator shown in FIG. 7.

FIG. 8 is a schematic diagram of an implementation of the voltage regulator 70. The circuit structure of the current source 10 is as in FIG. 4 but there is a slight difference in the circuit connections. The buffer 708 may be an NMOS MN0, and the buffer 708 together with the amplifier 702 and the voltage dividing resistors 704, 706 of the voltage regulation amplifier 700 and the conversion resistor 710 realize the circuit structure of the voltage regulator 70. The capacitors CMP1, CMP2, CMN1 and CMN2 in the current source 10 have a terminal coupled to the output terminal of the voltage regulator 70, and another terminal coupled to the nodes NDP1, NDP4, NDN1 and NDN4, respectively. The drain of the transistors MP3 and MN3 is coupled to the quick response control terminal N_FAST. The gate of the NMOS MN0 is coupled to the quick response control terminal N_FAST, the drain of the NMOS MN0 is coupled to the power supply terminal, and the source of the NMOS MN0 is coupled to the output terminal of the voltage regulator 70. In FIG. 8, the conversion resistor 710 is illustrated as a resistor, but in other embodiments, the conversion resistor 710 may also be realized by a diode-connected transistor, The equivalent resistance of the conversion resistor 710 may convert the current outputted by the current source 10 into a control voltage V_FAST of the quick response control terminal N_FAST.

When the load of the voltage regulator 70 rapidly draws a large current, the transistor MP3 may immediately output a large current via a quick response of the current source 10. This current may flow to the conversion resistor 710 via the quick response control terminal N_FAST, so that the control voltage V_FAST of the quick response control terminal N_FAST may rise quickly. The rising control voltage V_FAST then controls the NMOS MN0 to rapidly output a large current to the load, in order to quickly provide the current required by the load. In comparison with the method of directly outputting currents to the load by the current source 10, the voltage regulator 70 uses the buffer 708 with a higher driving capability to drive the load; this further increases the speed of outputting currents. When the current requirement of the load falls rapidly, the transistor MN3 may immediately sink a large current via a quick response of the current source 10. This current may flow from the conversion resistor 710 to the current source 10 via the quick response control terminal N_FAST, so that the control voltage V_FAST of the quick response control terminal N_FAST may fall quickly. The falling control voltage V_FAST then controls the NMOS MN0 to be turned off rapidly, which quickly reduces the magnitude of the output current or stops supplying the output current.

Note that the control voltage V_FAST of the quick response control terminal N_FAST should be maintained at a specific voltage level in the steady state in order to optimize the operations of the quick response control terminal N_FAST controlling the transistor MN0. Preferably, the control voltage V_FAST may be equal or close to the output voltage VOUT plus the threshold voltage of the transistor MN0. In other words, the control voltage V_FAST may be approximately equal to a threshold value which allows the transistor MN0 to be in an intermediate state between an on-state and an off-state. The control voltage V_FAST is thereby equal to the voltage level which may just turn on the NMOS MN0 in the steady state, so that the NMOS MN0 may output a small current. When the load rapidly draws a large current, the control voltage V_FAST only needs to increase slightly for the transistor MN0 to rapidly output the large current. When the output current is excessively large, the control voltage V_FAST only needs to decrease slightly for the transistor MN0 to be turned off. In such a situation, the response speed of the voltage regulator 70 and the current source 10 for instant load current variations may become a maximum. If the voltage level of the control voltage V_FAST is too low, when the load rapidly draws a large current, the transistor MN0 cannot output currents for a small period of time from the control voltage V_FAST beginning to rise to the transistor MN0 being turned on. If the voltage level of the control voltage V_FAST is too high, when the current source 10 detects that the output current is excessively large, the transistor MN0 may still output currents for a small period of time from the control voltage V_FAST beginning to fall to the transistor MN0 being turned off; in this case, the steady current may also be larger.

In the circuit structure of the voltage regulator 70 shown in FIG. 8, the steady state voltage of the control voltage V_FAST is determined by the predefined current and the resistance value of the conversion resistor 710 when the current source 10 is in the steady state. Due to process variations, the resistance value may have a certain error no matter whether the conversion resistor 710 is realized by any type of resistor or the diode-connected transistor. There is also an error in the predefined current. These errors reduce the accuracy of the control voltage V_FAST in the steady state. To solve this problem, in an embodiment, the voltage regulation amplifier may further be coupled to the quick response control terminal N_FAST to maintain the bias voltage of the control voltage V_FAST in the steady state.

Figure 9:
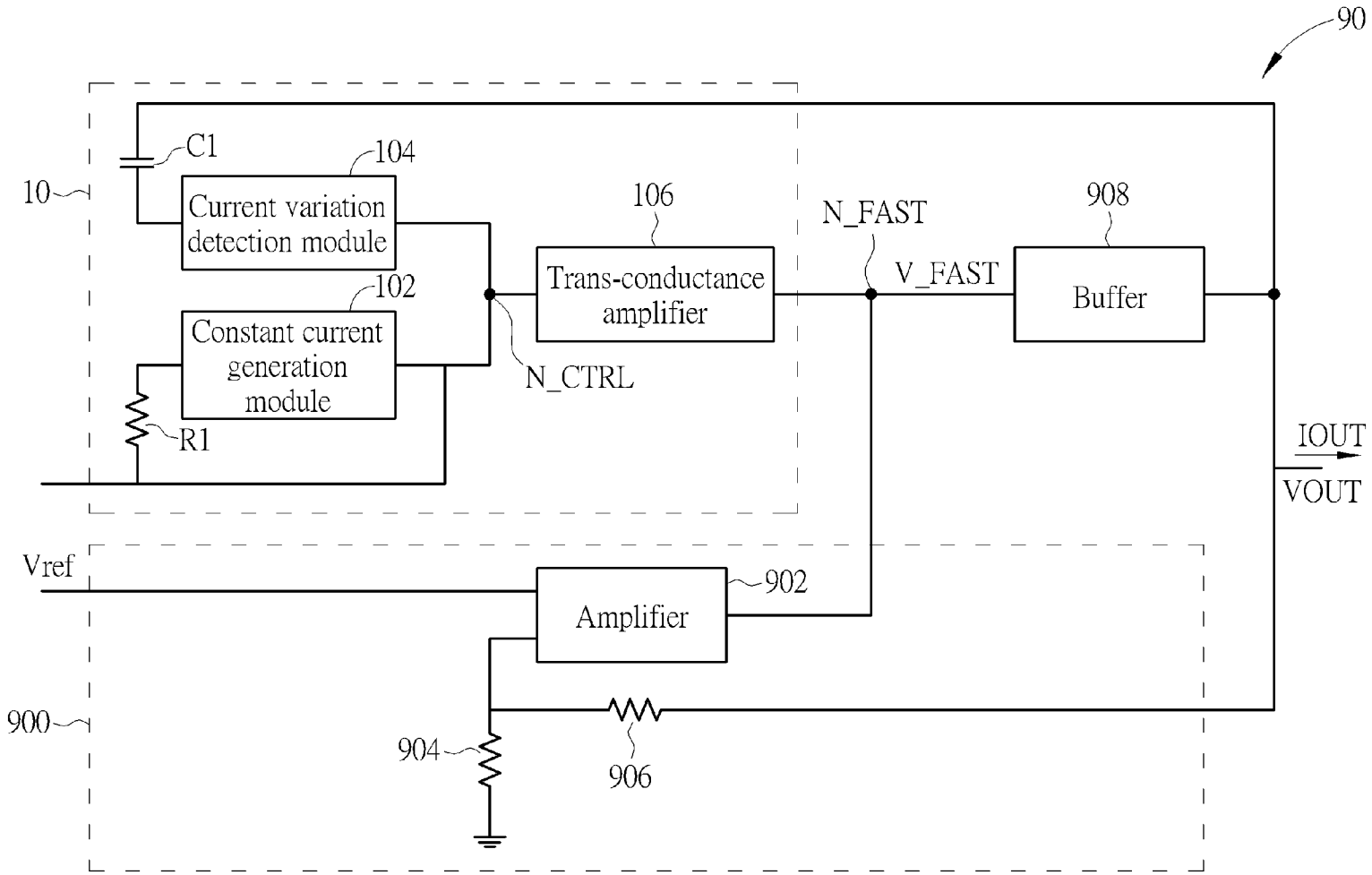
FIG. 9 is a schematic diagram of a further voltage regulator according to an embodiment of the present invention.

FIG. 9 is a schematic diagram of a further voltage regulator 90 according to an embodiment of the present invention. The voltage regulator 90 includes the current source 10, a voltage regulation amplifier 900 and a buffer 908. The voltage regulation amplifier 900 is utilized for maintaining an output voltage VOUT on the output terminal of the voltage regulator 90. The voltage regulation amplifier 900 includes an amplifier 902 and voltage dividing resistors 904, 906. The output terminal of the amplifier 902 is coupled to a quick response control terminal N_FAST. The voltage dividing resistors 904 and 906 are coupled to the output terminal of the buffer 908, which is also the output terminal of the voltage regulator 90 that provides the output voltage VOUT to the load. The voltage dividing resistors 904 and 906 may form a feedback circuit to maintain the output voltage VOUT on the output terminal of the voltage regulator 90 at a predetermined value in the steady state based on a reference voltage Vref. When the current requirement of the load terminal is fixed (i.e. steady state), the value of the output voltage VOUT is controlled by the voltage regulation amplifier 900, while the current source 10 may not affect the value of the output voltage VOUT. When a rapid variation occurs in the current requirement of the load terminal, the current source 10 and the quick response control terminal N_FAST then controls the buffer 908 to quickly provide a large current.

The main difference between the voltage regulator 90 and the voltage regulator 70 is that, in the voltage regulator 70, the output terminal of the amplifier 702 is coupled to the output terminal of the voltage regulator 70, but in the voltage regulator 90, the output terminal of the amplifier 902 is coupled to the quick response control terminal N_FAST for controlling the bias voltage of the quick response control terminal N_FAST (i.e. the control voltage V_FAST in the steady state). In such a situation, the voltage regulation amplifier 900 may control the bias voltage of the quick response control terminal N_FAST to a preferable voltage level, so that the control voltage V_FAST may be equal or close to the output voltage VOUT plus the threshold voltage of the transistor MN0. In addition, the equivalent output resistance of the amplifier 902 provides an equivalent resistor between the quick response control terminal N_FAST and the ground terminal; this means the voltage regulator 90 does not need any conversion resistor.

Figure 10:
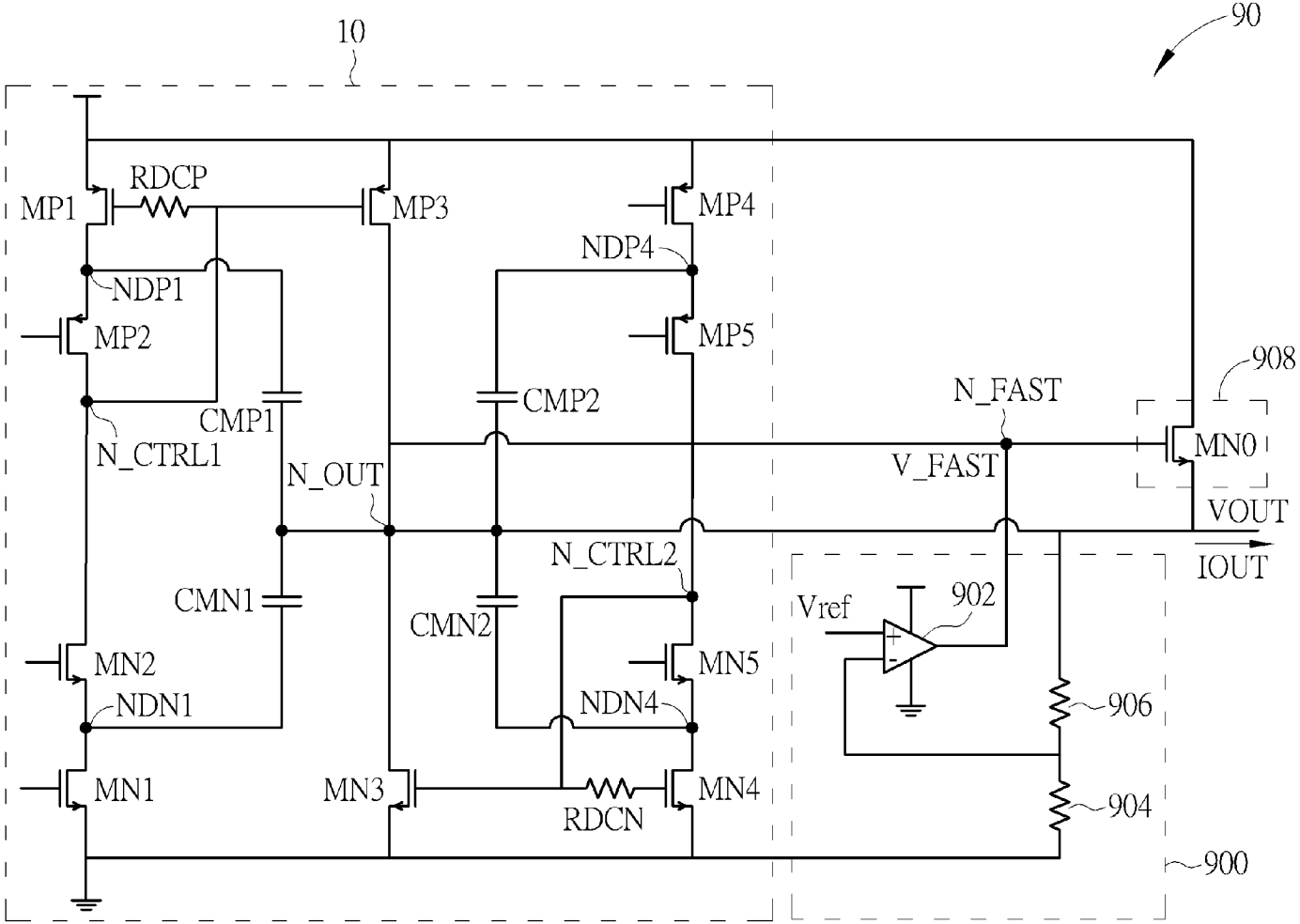
FIG. 10 is a schematic diagram of an implementation of the voltage regulator shown in FIG. 9.

FIG. 10 is a schematic diagram of an implementation of the voltage regulator 90. The circuit structure of the current source 10 is as in FIG. 4, and its circuit connections are the same as the current source 10 shown in FIG. 8. The buffer 908 may be an NMOS MN0, and the buffer 908 together with the amplifier 902 and the voltage dividing resistors 904, 906 of the voltage regulation amplifier 900 realize the circuit structure of the voltage regulator 90. In FIG. 10, the operations and functions of the NMOS MN0 are the same as those of the NMOS MN0 shown in FIG. 8, and are denoted by the same symbol. Since the conversion resistor is not included in the voltage regulator 90, the equivalent output resistance of the amplifier 902 provides similar functions. When the load of the voltage regulator 90 rapidly draws a large current, the transistor MP3 may immediately output a large current via a quick response of the current source 10. This current may flow to the equivalent output resistance of the amplifier 902 via the quick response control terminal N_FAST, so that the control voltage V_FAST of the quick response control terminal N_FAST may rise quickly. The rising control voltage V_FAST then controls the NMOS MN0 to rapidly output a large current to the load, in order to quickly provide the current required by the load. When the current requirement of the load falls rapidly, the transistor MN3 may immediately sink a large current via a quick response of the current source 10. This current may flow from the equivalent output resistance of the amplifier 902 to the current source 10 via the quick response control terminal N_FAST, so that the control voltage V_FAST of the quick response control terminal N_FAST may fall quickly. The falling control voltage V_FAST then controls the NMOS MN0 to be turned off rapidly, which quickly reduces the magnitude of the output current or stops supply of the output current.

Conventional current sources and voltage regulators such as U.S. Publication No. 2009/0212753 A1 and U.S. Pat. No. 7,106,033 B1 have to detect the output voltage, and enable an instant current source to satisfy the current requirement of the load terminal when detecting that the output voltage falls due to rapid and large current requirement of the load. In comparison with the conventional current source where the output current is adjusted according to voltage variations, the present invention adjusts the output current according to load currents, resulting in a faster response speed. More specifically, the variation on the output voltage is a result caused by changing the load current; hence, the response speed of adjusting the output current directly according to load currents may be faster than detection of the output voltage variations. Ideally, when the response speed of the circuit is fast enough, current may be provided for the load before fluctuations on the output voltage are generated from the variations on the output current. As a result, the fluctuations on the output voltage due to the changing load current are minimized, and the voltage regulator can achieve the best regulation performance.

Note that the current source of the present invention is capable of quickly generating an output current to be provided for the load when the load has a large current requirement. The fluctuations on the output voltage generated due to the variance of load current can therefore be minimized in order to optimize the voltage regulation performance of the voltage regulator. Those skilled in the art can make modifications and alternations accordingly. For example, the current source 10 may be realized by the circuit structure shown in FIG. 2, FIG. 3 or FIG. 4 according to system requirements, or other circuit structures may be applied to output quick response currents. In addition, the realization of the voltage regulator may not be limited to the abovementioned voltage regulators 50, 70 and 90. The current source of the present invention may be applied together with various voltage regulation circuits with different structures to realize different types of voltage regulators, and this is not limited herein.

In order to achieve higher stability, a Miller compensation capacitor may be disposed between the output terminal of the voltage regulator 90 and an inverse output stage of the amplifier 902. The Miller compensation capacitor is utilized for enhancing the loop stability of the loop formed by the voltage regulation amplifier 900 and the buffer 908, and also utilized for reducing the bandwidth of the loop to reduce the response speed of the voltage regulation amplifier 900. As mentioned above, when rapid variations occur in the load current requirement, the current source 10 may respond quickly to adjust the control voltage V_FAST of the quick response control terminal N_FAST via the output current of the current source 10, in order to control the buffer 708 to quickly provide a large current. The reduction of response speed of the voltage regulation amplifier 900 can therefore prevent the voltage regulation amplifier 900 from influencing the control voltage V_FAST in a small period of time to influence the performance of the buffer 708 quickly providing currents.

To sum up, the current source of the present invention is capable of quickly generating an output current for the load when current requirements of the load increase rapidly, and can also quickly reduce the magnitude of the output current or provide a path for sinking a large current when the current requirements of the load decrease rapidly. The current source may directly output the instant current to the load terminal, and also control a buffer to provide an instant output current in order to increase the speed of supplying load currents. The voltage regulator using the above current source may rapidly generate an output current to prevent the output voltage from undergoing severe fluctuations due to current requirements of the load, and achieve the best voltage regulation performance while preventing the output voltage from being pulled down by the load current and causing malfunction.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A current source for quickly adjusting a first output current comprises:

a constant current generation module, coupled to a control node, for generating a predefined current flowing through the control node in order to determine a voltage of the control node;

a capacitor, coupled to an output terminal of the current source;

a current variation detection module, coupled between the control node and the capacitor, for generating a variation on the voltage of the control node via the capacitor when the output terminal of the current source receives an instant current variation; and a trans-conductance amplifier, coupled between the control node and the output terminal, for changing a magnitude of the first output current of the output terminal when the variation on the voltage of the control node is generated;

wherein the output terminal of the current source is coupled to a buffer, in order to control the buffer to output a second output current.

2. The current source of claim 1, further comprising:

a resistor, coupled to the control node, for preventing the constant current generation module from generating another instant current to offset the variation on the voltage of the control node.

3. The current source of claim 1, wherein the buffer is an N-type metal oxide semiconductor field-effect transistor (NMOS), having a drain coupled to a power supply terminal, a source coupled to the capacitor, and a gate coupled to the output terminal, wherein the current source controls the NMOS to output the second output current according to a load variation on the source of the NMOS.

4. The current source of claim 1, wherein the constant current generation module comprises a current mirror, for controlling the magnitude of the first output current to be equal to the predefined current in a steady state.

5. A voltage regulator, comprising:

a buffer, coupled between an output terminal of the voltage regulator and a quick response control terminal, for generating an output current;

a current source, coupled to the buffer, comprising:

a constant current generation module, coupled to a control node, for generating a predefined current flowing through the control node in order to determine a voltage of the control node;

a capacitor, coupled to the output terminal of the voltage regulator;

a current variation detection module, coupled between the control node and the capacitor, for generating a variation on the voltage of the control node via the capacitor when the output terminal of the voltage regulator receives an instant current variation; and a trans-conductance amplifier, coupled between the control node and the quick response control terminal, for generating an output signal on the quick response control terminal when the variation on the voltage of the control node is generated, in order to control the buffer to change a magnitude of the output current; and a voltage regulation amplifier, coupled between the output terminal of the voltage regulator and the quick response control terminal, for maintaining an output voltage of the output terminal and determining a bias voltage of the quick response control terminal.

6. The voltage regulator of claim 5, wherein the current source further comprises:

a resistor, coupled to the control node, for preventing the constant current generation module from generating another instant current to offset the variation on the voltage of the control node.

7. The voltage regulator of claim 5, wherein the buffer is an N-type metal oxide semiconductor field-effect transistor (NMOS), having a drain coupled to a power supply terminal, a source coupled to the output terminal of the voltage regulator, and a gate coupled to the quick response control terminal.

8. The voltage regulator of claim 7, wherein the quick response control terminal is coupled to an output terminal of the voltage regulation amplifier, in order to control the bias voltage of the quick response control terminal to be equal or close to the output voltage plus a threshold voltage of the NMOS.

9. The voltage regulator of claim 5, further comprising:

a Miller compensation capacitor, coupled between the output terminal of the voltage regulator and an inverse output stage of the voltage regulation amplifier, for enhancing a loop stability of the voltage regulation amplifier and the buffer.

* * * * *